US005765438A

United States Patent [19]

Chang

[11] Patent Number: 5,765,438

[45] Date of Patent: Jun. 16, 1998

[54] MANUAL STARTER FOR MODEL ENGINES

[76] Inventor: Lien-Sheng Chang, 1F, No. 30, Alley 72, Lane 799, San Feng Rd., Feng Yuan City, Taichung, Taiwan

[21] Appl. No.: 705,634

[22] Filed: Aug. 30, 1996

[51] Int. Cl.[6] ..... F02N 3/02

[52] U.S. Cl. ..... 74/6; 74/7 C; 123/185.3

[58] Field of Search ..... 74/6, 7 C; 123/185.3, 123/185.2

[56] References Cited

U.S. PATENT DOCUMENTS

| | | | |
|---|---|---|---|
| 4,480,605 | 11/1984 | Bloemers | 74/6 X |
| 4,582,030 | 4/1986 | Reese | 74/6 |
| 4,638,775 | 1/1987 | Lindstrom | 74/7 C X |
| 5,163,393 | 11/1992 | Naslund | 123/185.3 |
| 5,329,896 | 7/1994 | Everts | 123/185.3 |

*Primary Examiner*—Charles A. Marmor
*Assistant Examiner*—Troy Grabow
*Attorney, Agent, or Firm*—Bacon & Thomas

[57] ABSTRACT

A manual starter for model engines includes a winding wheel unit and a clutch unit. The clutch unit has a base, a starting device, a position device, an urging device and a return device combined together. The starting device is both rotated and moved backward by the winding wheel rotated by a pull rope wound around the winding wheel, moving an engage shaft into engagement with and to rotate a piston crank of a model engine so as to start the engine. Then after the engine is started, the engage shaft is automatically retracted by the position device and the urging device to be disengaged from the piston crank, permitting the engine to operate freely.

5 Claims, 6 Drawing Sheets

MANUAL STARTER FOR MODEL ENGINES

BACKGROUND OF THE INVENTION

This invention concerns a manual starter for model engines, particularly those used for model cars, ships, helicopters, etc.

A known conventional manual starter for model engines is shown in FIG. 1, including a base 1, a T-shaped connect rod 2, a winding wheel unit 3, and an activating pin 4 combined together with an model engine.

The base 1 is fitted in a hole 5*a* of a model engine 5, having an axial center hole 1*a* for the shank of the T-shaped connect rod 2 to fit rotatably therein. The T-shaped connect rod 2 has a front nut-shaped portion 2*a* to fit firmly in a position hole 3*b* of a winding wheel 3*a* of the winding wheel unit 3. The T-shaped connect rod 2 has a rear disc portion of a larger diameter than the shank, and the rear disc portion has three curved grooves 2*b* spaced apart in a rear end surface facing a piston crank 5*c* of the engine. The curved grooves 2*b* are located along a peripheral edge of the disc portion, respectively having a sloped down bottom face to form a shallow end and a deep end and a stop face 2*c* at the deep end. The activating pin 4 is placed in a rod 5*d* eccentrically fixed on a front end surface of a shaft 5*b* of the engine 5 urged by a compress spring 4*a* so as to let the front end of the activating pin 4 contact and elastically push into one of the curved grooves 2*b* of the connect rod 2. The winding wheel unit 3 has a winding wheel 3*a* and a pull rope 3*c* wound around the winding wheel 3*a*, a spiral spring 3*d* fixed at a front side of the winding wheel 3*a* and a housing 3*e* containing the remaining components of the winding wheel unit 3.

When the model engine is to be started, the pull rope 3*c* is pulled out with force, rotating the winding wheel 3*a* counterclockwise, as viewed in the direction shown by the dotted line in FIG. 1 from the front side of the engine 5. Then the T-shaped connect rod 2 and the curved grooves 2*b* are rotated also counterclockwise, and consequently the activating pin 4 is simultaneously rotated counterclockwise, with its end always being in contact with one of the curved grooves 2*b* of the connect rod 2 by means of the elasticity of the compress spring 4*a*. So when the connect rod 2 is rotated counterclockwise, the activating pin 4 will move forward guided by the sloped groove 2*b* for a certain distance and finally be stopped by the stop face 2*c* of the curved groove 2*b* and then be rotated to force the piston crank 5*c* and the shaft 5*b* to rotate counterclockwise as well to start the engine 5.

After the engine is started, the pull rope 3*c* is released and wound back around the winding wheel 3*a* by elasticity of the spiral spring 3*d*. Meanwhile, the connect rod 2 and the sloped grooves 2*b* are rotated clockwise together with the winding wheel 3*a*. The shaft 5*b* is rotating counterclockwise along with the activating pin 4 which is no longer stopped by the stop face 2*c* of the curved groove 2*b*. Therefore, the connect rod 2 does not rotate together with the shaft 5*b* after the engine 5 is started.

However, the known conventional manual starter for model engines is deemed to have the following drawbacks.

1. When a model engine is running at the highest speed it may reach 20,000–30,000 rpm. The activating pin 4 keeps in contact with the front end surface of the connect rod 2 during rotation, producing mutual friction between the contacting surfaces of the both, thereby causing wear and tear of both the components. In addition, the output power of the shaft 5*b* is also reduced owing to the resistant force of the friction. At the same time, the compress spring 4*a* will wear quickly because of very frequent compressing and lengthening movement in accordance with the rod which moves frequently along the curved groove 2*b*. Besides, the faster the shaft rotates the larger is the frequency of compression and lengthening of the compress spring 4*a*.

2. As can be seen from the above description, there exists contact friction between the activating pin 4 and the connect rod 2. Thus the engine encounters some resistance caused by that friction, with the output power of the engine reduced accordingly. Most model engines generally have 1–3 hp output, so this kind of loss of output may not be considered little.

3. After the engine begins to rotate, the T-shaped pull rod 2 rotates clockwise and the activating pin 4 rotates counterclockwise, with its outer end sliding on the curved grooves 2*b* but not stopped by the stop face 2*c*. When the activating pin falls 4 from the top of the stop face 2*c* to the deepest bottom face of the curved groove 2*b*, it will emit a colliding sound when the engine rotates at a low speed or an idle speed. The depth difference between the top of the stop face 2*c* and the deepest bottom face of each curved groove 2*b* is the largest. Therefore, every time the activating pin 4 falls from the stop face 2*c* to the deepest bottom face of each of the three curved grooves 2*b*, it produces noise while the engine is in motion.

SUMMARY OF THE INVENTION

The purpose of the invention is to offer a manual starter for model engines, having a clutch unit that can function to separate a winding wheel unit from a model engine after the model engine is started by the winding wheel unit, without affecting the output power of the engine.

A main feature of the invention is a clutch unit, wherein a base is fixed in a hole in a rear portion of a model engine, an engage shaft and a pull rod combined with the base. When the pull rod is rotated by a winding wheel rotated by a pull rope, the engage shaft is moved axially and then rotated to rotate a pin fixed on the shaft of the engine and then the piston crank so as to start the engine. After the engine is started, the engage shaft completely separates from the pin of the shaft of the engine by means of a return unit, returning to an original position, i.e. ready for a next starting operation.

BRIEF DESCRIPTION OF DRAWINGS

This invention will be better understood by reference to the accompanying drawings, wherein.

DESCRIPTION OF THE PREFERRED EMBODIMENT

Figure 1:
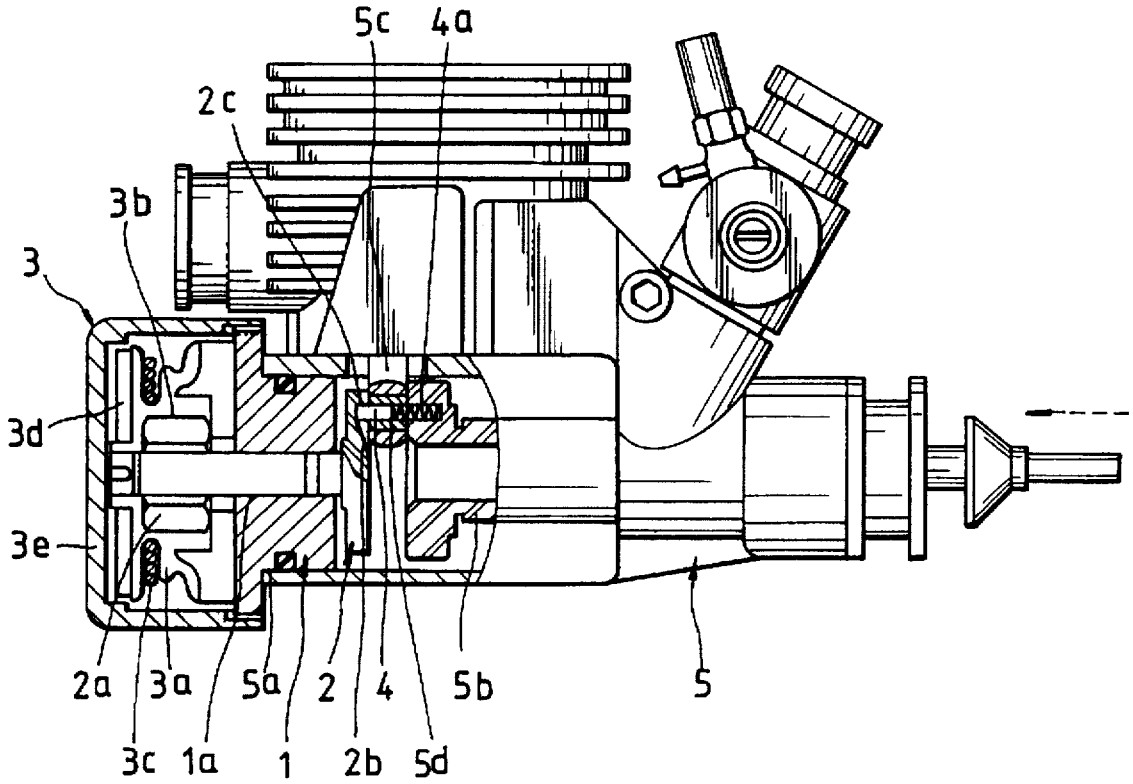
FIG.1 PRIOR ART
FIG. 1 is a cross-sectional known conventional manual starter for model engines.
Figure 2:
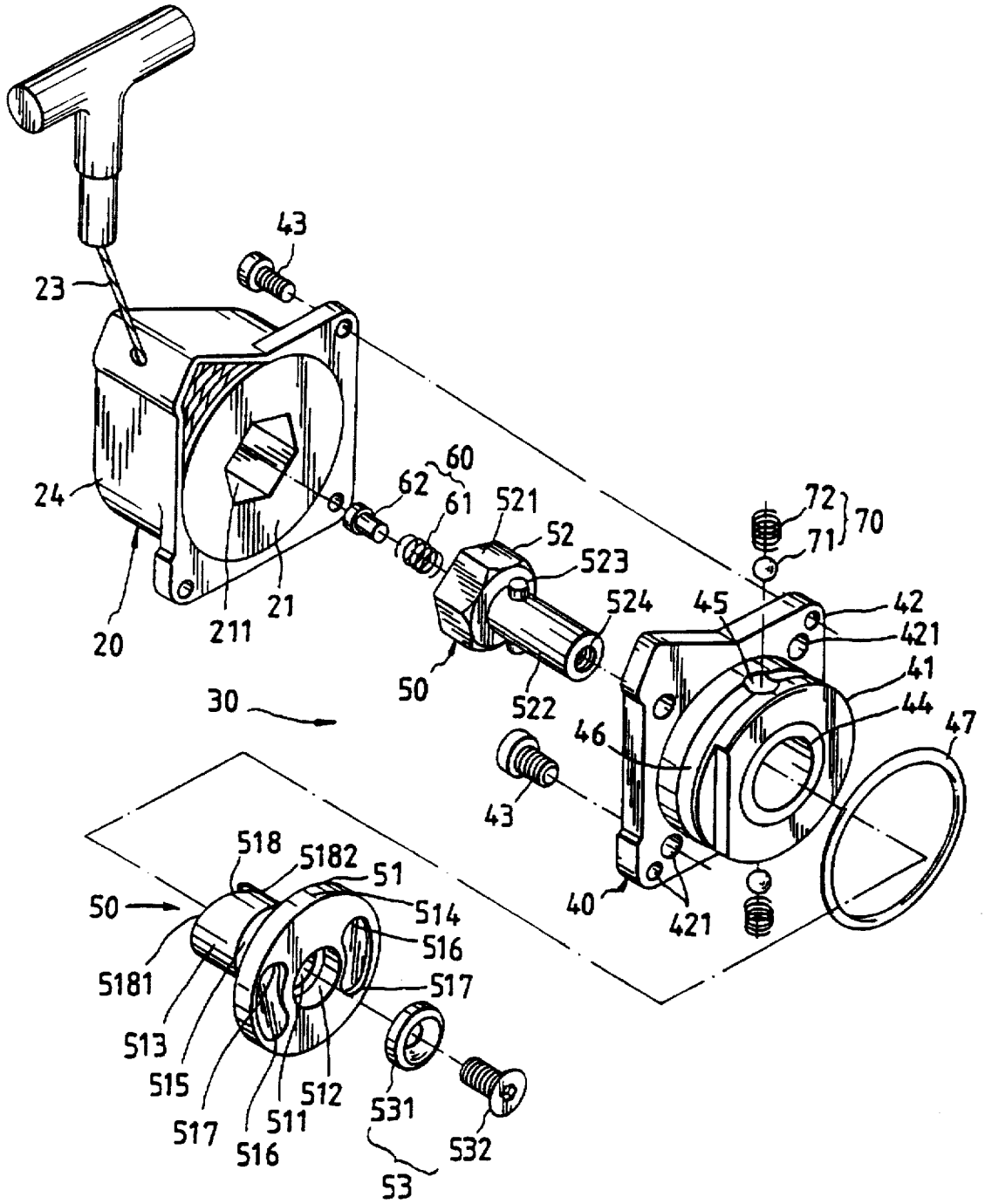
FIG. 2 is an exploded perspective view of a preferred embodiment of a manual starter for model engines according to the present invention.

A first preferred embodiment of a manual starter 10 for model engines in the present invention, as shown in FIG. 2 includes a winding wheel unit 20, and a clutch unit 30, combined together.

The winding wheel unit 20 includes a winding wheel 21, a spiral spring 22, a pull rope 23, and a housing 24 combined together. This unit 20 in the present invention has the same structure as that of the known conventional manual starter described above.

Figure 3:
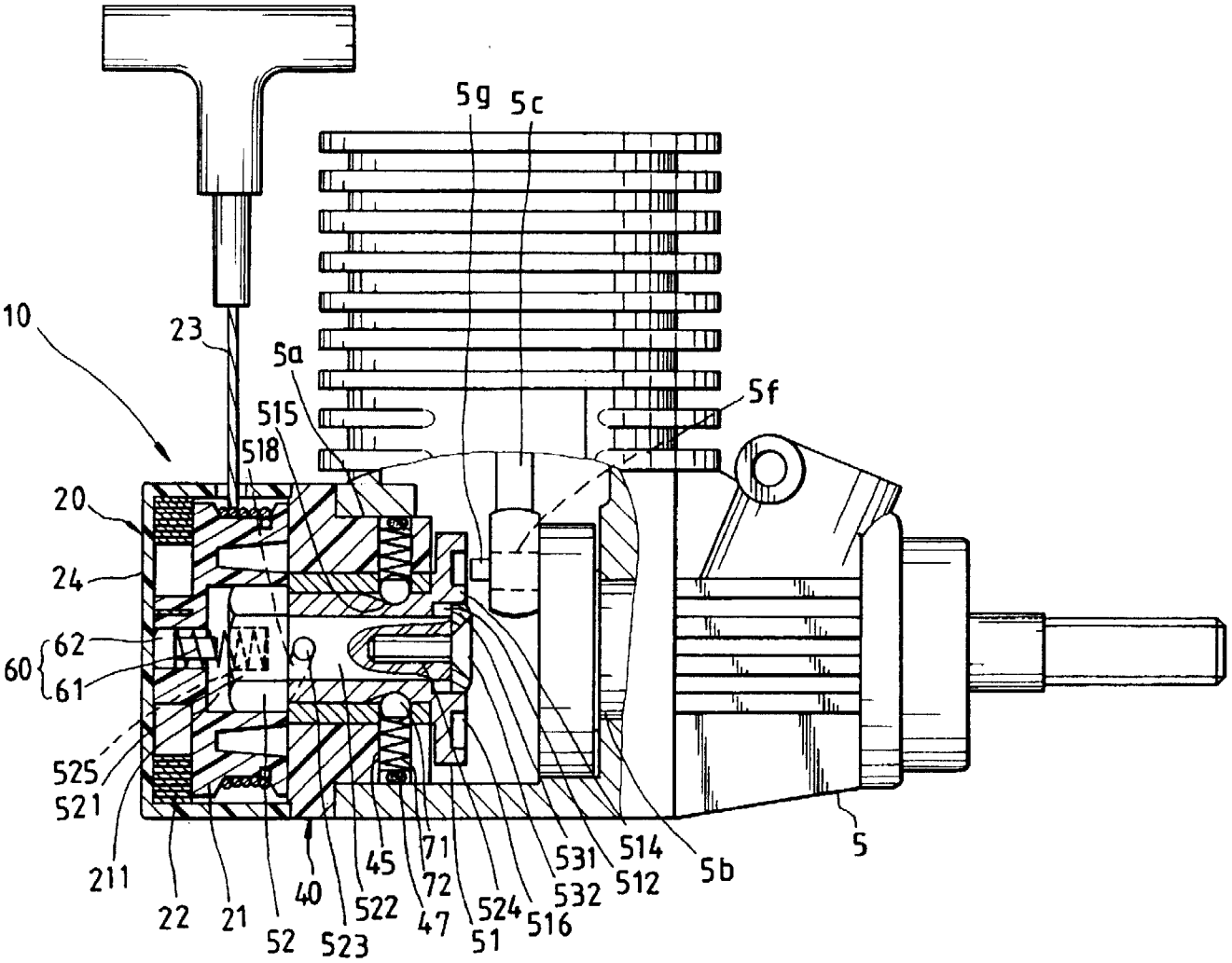
FIG. 3 is a cross-sectional view of the preferred embodiment of a manual starter for model engines according to the present invention.

The clutch unit 30, as shown in FIG. 3, includes a base 40, a starting means 50, an urging means 60 and a return means 70 combined together.

The base 40 has a rear cylindrical portion 41 to fit into a mouth of a hole 5*a* of a model engine 5, and a front square flat plate portion 42. The front square flat plate portion 42, which has a larger dimension than the rear cylindrical portion 41, has plural combining holes 421 in four corners for screws 43 such as hexagonal screws to combine the base 40 with the end surface of the hole 5*a* of the engine 5 and with the housing 24 as well. The base 40 further has an axial center hole 44 and two lateral holes 45, 45 bored upright through the rear cylindrical portion and communicating, with the center hole 44. The base 40 further has lap annular groove 46 passing across the lateral holes 45, 45 and an O ring 47 fitting around the annular groove 46 so as to close up the aperture between the rear cylindrical portion 41 and the opening 5*a* of the engine 5.

The starting means 50 includes an engage shaft 51, a push rod 52 and a position means 53 combined together.

The engage shaft 51 is made of a metal and shaped as T, having a lengthwise shaft hole 511, a ring hole 512 of a larger diameter than the shaft hole 511 formed in a rear end portion of the shaft hole 511 for a shaft 5*b* of the engine 5 to fit therein, a front small diameter rod portion 513 to fit in the center hole 44 of the base 40, a large diameter rear disc portion 514 located between the base 40 and the shaft 5*b* of the engine 5. The front rod portion 513 has a return annular groove 515 gradually deepening towards the rear disc portion 514. The return annular groove 515 is just located to face the lateral holes 45, 45 of the base 40 after the front rod portion 513 is fitted in the center hole 44 of the base 40 and has a cross-section sloping down towards the rear disc portion 514. The rear disc portion 514 has two opposite engage slots 516 curving in a round direction and having one deeper end with a stop face 517 than the other end. The shaft 5*b* of the engine 5 has an eccentric pin 5*f* and a projection 5*g* extending forward from the pin 5*f*. The front rod portion 513 has a front end annular stop face 518 formed in a preset slope with two highest points 5181, 5181 and two lowest point 5182, 5182.

The push rod 52 has a front hexagonal nut-shaped portion 521 to fit in a hexagonal hole 211 of the winding wheel 21, and a rear round rod portion 522 to extend in the shaft hole 511 of the engage shaft 51. The rear round rod portion 522 has two opposite round sidewise push projections 523, 523 near the nut-shaped portion 521, and the periphery of the sidewise projections 523, 523 contact the curved stop face 518 of the engage shaft 51. The rear round rod portion 522 is a little longer than the shaft hole 511, extending in the ring hole 512, but not longer than the farthest distance in which the engage shaft 51 moves after the sidewise projections 523, 523 contact and push the stop face 518. Further, the rear round rod portion 522 has a threaded hole 524 in the free end, and the front nut-shaped portion 52 has a recess 525 in the front end surface.

The position means 53 includes a position ring 531 having a center cone-shaped hole and a screw 532 having a cone-shaped head to fit in the center cone-shaped hole of the position ring 531 and protruding through the center hole to engage the threaded hole 524 of the push rod 52, with the periphery of the position ring 531 just contacting the bottom of the ring hole 512, combining the engage shaft 51 with the push rod 52. At the same time, the position ring 531 functions to limit the largest moving distance of the engage shaft 51 relative to the push rod 52.

The urging means 60 includes a compress spring 61, and a center rod 62. The compress spring 61 fits around the center rod 62, having a rear end resting in the recess 525 of the front nut-shaped portion 521 of the push rod 52, and a front end resting on a head of the center rod 62 which always contacts the front side wall of the housing 24 of the winding wheel unit 20. Thus the compress spring 61 always urges the push rod 52.

Next, functions and actions of the various components will be described, with reference to FIGS. 2 and 3. While the clutch unit 30 is still motionless, the disc portion 514 of the engage shaft 51 is separated with a certain distance from the outer end of the pin 5*f* of the shaft 5*b* of the engine 5, with the steel beads 71, 71 of the return means 70 located at the lowest point in the annular groove 515, with the front nut-shaped portion 52 urged by the urging means 60 to contact the front end surface of the front square plate portion 42 of the base 4, and with the push projections 523, 523 of the rear rod portion 522 pushing the lowest points 5182, 5182 of the stop face 518 of the engage shaft 51.

Figure 4:
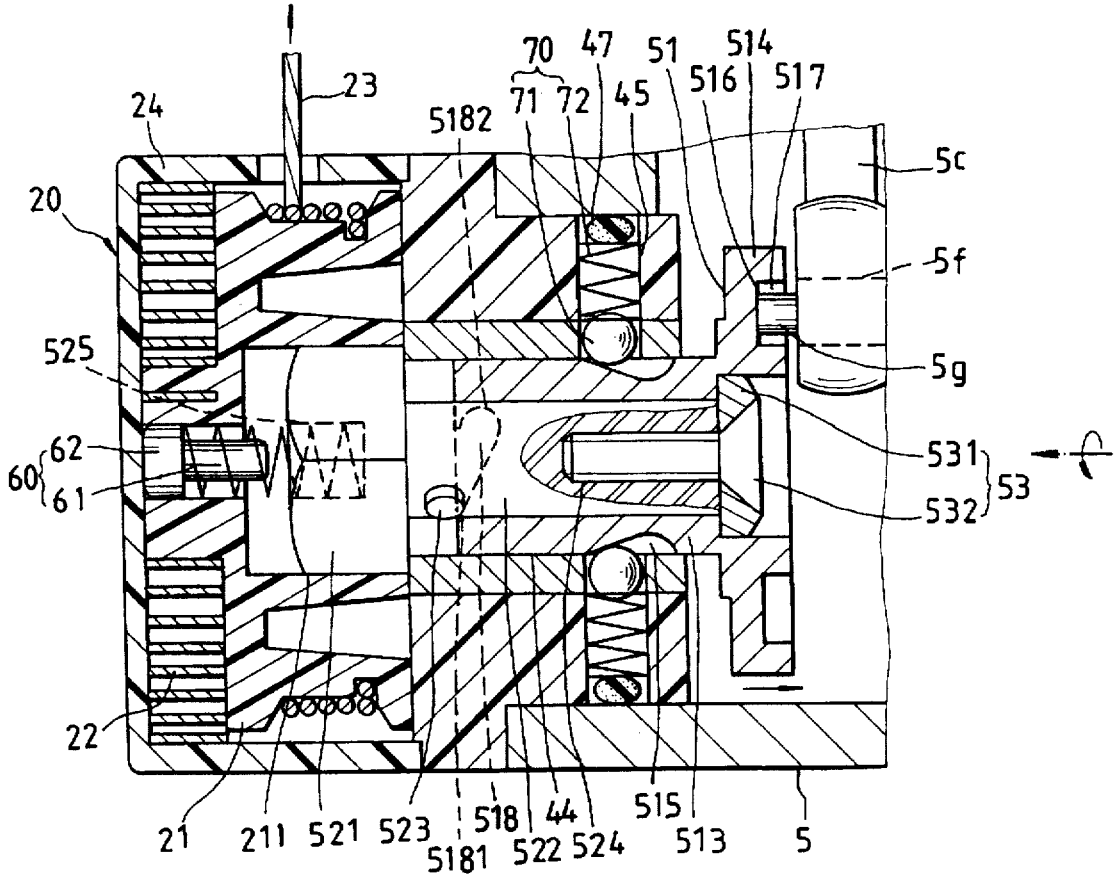
FIG. 4 is a cross-sectional view of the preferred embodiment of a manual starter for model engines according to the present invention, showing how a clutch unit of the manual starter is moved.
Figure 5:
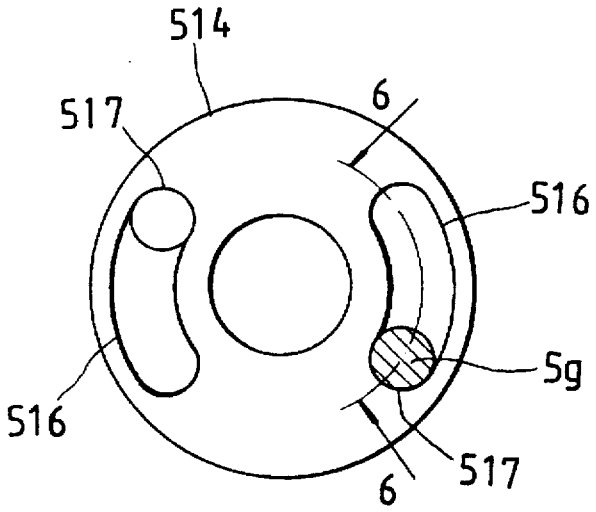
FIG. 5 is front view of an engage shaft engaging and moving a pin of a shaft of a model engine according to the present invention.
Figure 6:
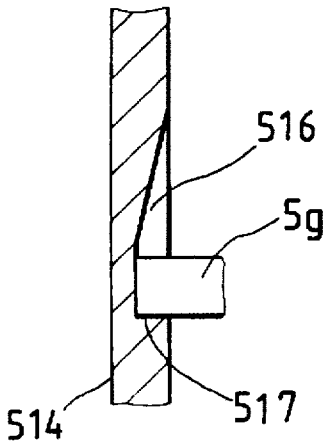
FIG. 6 is a cross-sectional view of line 6—6 in FIG. 5.

Further, referring to FIG. 4, if the pull rope 23 is pulled out with force, it rotates the winding wheel 21 around which the rope 23 is wound, then rotating the push rod 52 in counterclockwise, as shown in the arrow in FIG. 4 when viewed from the front side of the engine 5. In the meantime, the push projections 5182, 5182 are also revolved to move from the lowest points 5182, 5182 of the stop face 518 of the engage shaft 52 to the highest points 5181, 5181 of the same, with the push rod 52 stopped by means of the elastic force of the urging means 60 being larger than that of the return means 70. Therefore, the engage shaft 51 moves axially towards the shaft 5*b* of the engine 5 in the largest distance preset by movement of the push projections 523, 523, when the push projections 523, 523 rotates and moves to the highest points 5181, 5181 of the stop face 518. Then the position ring 531 can force the push projections 523, 523 stop at the highest points 5181, 5181 so the engage shaft 51 may be further rotated in the same direction as the push rod 52, and the engage slots 516, 516 rotate with the disc portion 514, with the engage face 517 of one of the engage slots 516 engaging with the projection 5*g* of the pin 5*f* as shown in FIGS. 5 and 6. So the projection 5*g* is rotated by the slot 517, and consequently the piston crank 5 is moved to rotate the shaft 5*b*, starting the engine 5.

Figure 7:
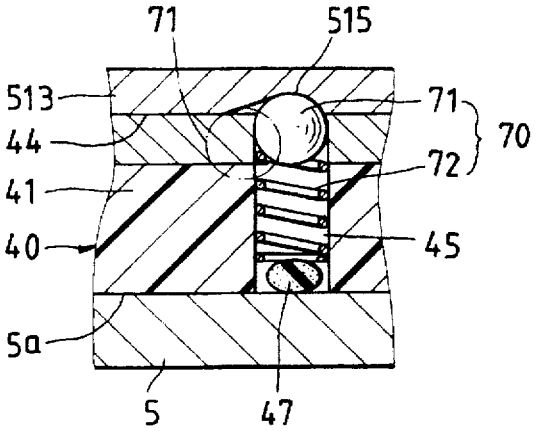
FIG. 7 is a cross-sectional view of a steel bead blocking the engage shaft from returning to its original position in the present invention; and, FIG. 8 is a cross-sectional view of two stop projections in a shaft hole of the engage shaft fitting in an annular groove of a pull rod in a second preferred embodiment according to the present invention.

After the engine 5 is already started, the pull rope 23 is released and wound back around the winding wheel 21 rotated clockwise by elasticity of the spiral spring 22. Then the push rod 52 is also rotated clockwise by the winding wheel 22, with the push projections 523, 523 leaving the highest points 5181, 5181 of the stop face 518, and with the force of pushing the engage shaft 51 disappearing. Now, referring to FIGS. 3 and 7, the compress springs 72, 72 of the return means 70 elastically pushes the steel beads 71, 71 move from the highest point to the lowest point in the annular groove 515 of the front rod portion 513 so as to permit the engage shaft 51 return to the original motionless position, with the engage slots 516, 516 completely disengaging from the projection 5*g*. Then the pull rod 52 also returns to the original position, with the push projections 523, 523 moving back to the lowest points 5182, 5182 of the stop face 518. Again the whole starter 10 goes back to a motionless position, ready for the next operation.

It has to be noticed that engagement of the engage slots 516, 516 with the projection 5*g* of the pin 5*c* is depended upon both axial movement and rotation of the engage shaft 51 simultaneously. In order to avoid tight engagement of the slots 516, 516 with the projection 5*g* before they engage totally, the urging means 60 is provided between the pull rod 52 and the housing 24 so that the compress spring 61 may be pressed to enable the engage shaft 51 to gradually rotate to permit the projection 5*g* insert in the slots 516, 516.

Figure 8:
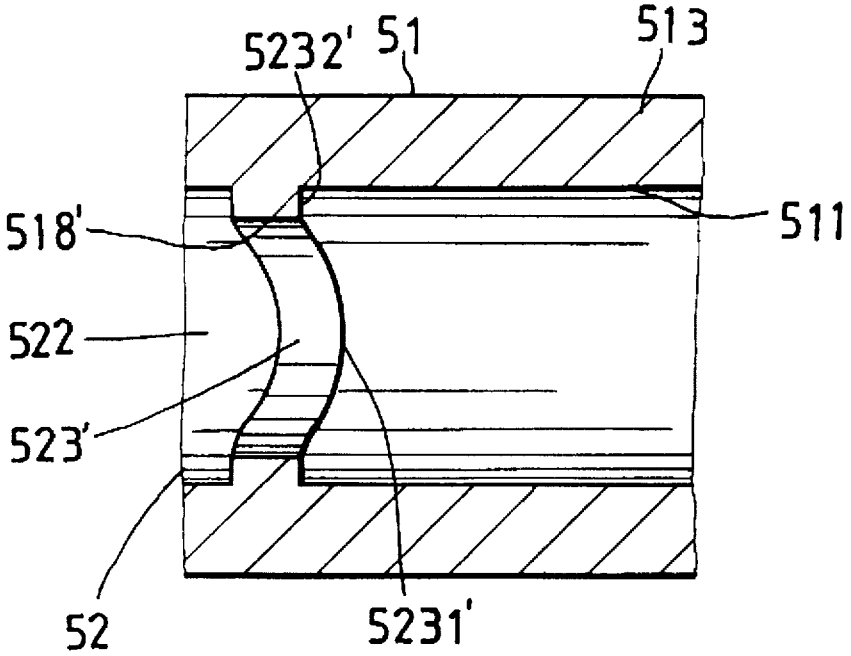

A second preferred embodiment of the manual starter for model engines is shown in FIG. 8, having the same structure as the first preferred embodiment except the engage shaft 51 and the pull rod. The engage shaft 51 in the second embodiment has two stop projections 518', 518' located oppositely on an inner wall of the shaft hole 511 instead of the front stop face 518 of the rod portion 513 of the engage shaft 51 of the first embodiment. The pull rod 52 of the second embodiment has an annular groove 523' in the periphery of the rear rod portion 522 instead of the push projections 523 of the first embodiment. The annular groove 523' has two half curved portions of a preset curvature so as to form two highest points 5231' and two lowest points 5232'. The two stop projections 518', 518' of the engage shaft 51 fit in the annular groove 523' of the pull rod 52, and the both function in the same way as the engage shaft 51 and the pull rod 52 of the first embodiment.

This invention, as can be understood from the above description, has advantages that the clutch unit 30 can not only start a model engine but also can separate from the engine completely, with the engine not affected at all in its operation, and with less noises produced by the engine than conventional model engines, resulting in increasing service life of the engine and in reducing break-down of the components.

While the preferred embodiments of the invention have been described above, it will be recognized and understood that various modifications may be made therein and the appended claims are intended to cover all such modifications which may fall within the spirit and scope of the invention.

What is claimed is:

1. A manual starter for a model engine, the manual starter having a winding wheel and comprising:

a clutch unit including:

a base having: a rear cylindrical portion fitting in a hole of the model engine; and a front square flat plate portion affixed to an outer end surface of said hole of said engine, said base having an axial center hole, said rear cylindrical portion having two lateral diametrically opposite holes communicating with said axial center hole;

a starting device including: an engage shaft, a push rod and (3) a position device, said engage shaft being T-shaped and having a front rod portion and a rear disc portion, said front rod portion having an annular groove in a periphery, said annular groove having a sloping cross-sectional configuration, said slope sloping inwardly toward said rear disc portion, said rear disc portion having a front end contacting a rear end surface of said base and located between said base and a shaft of said model engine, said rear disc portion further having a plurality of slots, said slots each sloping in the same direction and having a first end deeper than a second end so as to releasably engage a pin on said shaft of said model engine, said engage shaft further having an axial center hole and a ring hole with a larger diameter than said axial center hole and communicating with a rear end of said center hole, said front rod portion further having a stop face formed on a front end surface; said push rod having a front nut-shaped portion fitting in a hole in said winding wheel, and a rear rod portion fitting in said axial center hole of said engage shaft, said push rod engaging said engage shaft and moving said engage shaft forward in an axial direction when said push rod is rotated by said winding wheel, said rear rod portion being longer than said axial center hole of said engage shaft to extend into said ring hole an extended distance, the extended distance being not longer than a largest axial moving distance of said engage shaft, said rear rod portion further having a threaded hole in its rear end;

a position device having a position ring and a screw, said screw passing through said position ring and engaging said threaded hole of said rear rod portion of said push rod, said position ring located in said ring hole of said engage shaft and having a peripheral surface contacting a bottom of said ring hole so as to limit the axial moving distance of said engage shaft relative to said push rod, and attaching said engage shaft and said push rod;

an urging device located between said front nut-shaped portion of said push rod and a front wall of a housing of said winding wheel providing an elastic force urging said front nut-shaped portion into contact with said front square flat plate portion of said base and simultaneously preventing said engage shaft from engaging said pin of said engine when said engage shaft and said pin do not engage smoothly; and, a return device having two steel beads and two compress springs, located in said lateral diametrically opposite holes of said rear cylindrical portion of said base, said steel beads respectively engaging said annular groove of said front end portion of said engage shaft and elastically urged into engagement of said annular groove by said compress springs.

2. The manual starter for a model engine as claimed in claim 1, wherein said engage shaft has a stop face formed on a front end surface of said front rod portion, said stop face having two slopes each having a highest point and a lowest point; and said push rod has two opposite projections on said rear rod portion, said two projections normally contacting said lowest points of said annular stop face of said engage shaft, and moving to said highest points when the winding wheel is rotated, thereby axially moving said engage shaft for a preset distance to engage the pin on the shaft of said model engine.

3. The manual starter for a model engine as claimed in claim 1, wherein said engage shaft has two opposite projections on an inner wall of said shaft hole, and said push rod has an annular groove in a periphery of said rear rod portion engaged by said two projections, said annular groove having two curved portions each respectively with a highest point and a lowest point, said two projections normally being located at said lowest points, whereby said engage shaft will be moved in an axial direction for a preset distance when said push rod is rotated, with said highest points of said annular groove moving to contact said two projections.

4. The manual starter for a model engine as claimed in claim 1, wherein said rear cylindrical portion of said base has an annular groove on its periphery passing across said two lateral diametrically opposite holes thereof, an O ring fitted in said annular groove so as to retain said two compress springs and said steel beads in said lateral diametrically opposite holes.

5. The manual starter for a model engine as claimed in claim 1, wherein said urging device includes a center rod and a center rod spring.

* * * * *